US009610484B2

(12) United States Patent
Gaffney

(10) Patent No.: US 9,610,484 B2
(45) Date of Patent: Apr. 4, 2017

(54) GOLF CLUB HEAD COVER

(71) Applicant: John Travis Gaffney, Phoenix, AZ (US)

(72) Inventor: John Travis Gaffney, Phoenix, AZ (US)

( * ) Notice: Subject to any disclaimer, the term of this patent is extended or adjusted under 35 U.S.C. 154(b) by 728 days.

(21) Appl. No.: 13/843,046

(22) Filed: Mar. 15, 2013

(65) Prior Publication Data

US 2013/0213538 A1 Aug. 22, 2013

Related U.S. Application Data

(63) Continuation of application No. 12/359,011, filed on Jan. 23, 2009, which is a continuation-in-part of application No. 12/079,839, filed on Mar. 28, 2008, now Pat. No. 8,276,627.

(51) Int. Cl.

| | |
|---|---|
| ***A63B 57/00*** | (2015.01) |
| ***A63B 55/00*** | (2015.01) |
| ***A63B 60/62*** | (2015.01) |

(52) U.S. Cl.

CPC ..... *A63B 55/007* (2013.01); *A63B 60/62* (2015.10); *A63B 2209/08* (2013.01)

(58) Field of Classification Search

CPC ..... A63B 55/007; A63B 57/0087; A63B 2209/10; A63B 2209/08; A63B 47/04

USPC ..... 150/154, 159, 160; 206/315.3, 315.4

See application file for complete search history.

(56) References Cited

U.S. PATENT DOCUMENTS

| | | | | |
|---|---|---|---|---|
| 2,508,525 A | | 5/1950 | Le Fevre | |
| 2,705,039 A | | 3/1955 | Halter | |
| 3,023,795 A | | 3/1962 | Denkert | |
| 3,593,765 A | * | 7/1971 | Monestere, Jr. | A61F 5/441 128/DIG. 24 |
| 3,593,769 A | | 7/1971 | Spears | |
| 3,997,169 A | * | 12/1976 | Bergstrom | A63B 47/02 294/19.2 |
| 4,660,610 A | * | 4/1987 | McIntire, III | B23K 37/00 150/161 |
| 4,898,222 A | * | 2/1990 | Gaffney | A63B 60/62 150/160 |
| 5,050,655 A | * | 9/1991 | Borenstein | A63B 60/62 15/105 |

(Continued)

FOREIGN PATENT DOCUMENTS

| | | |
|---|---|---|
| CN | 2922956 Y | 4/2006 |
| JP | 2003-62137 A | 4/2003 |

(Continued)

*Primary Examiner* — Anthony Stashick
*Assistant Examiner* — Cynthia Collado
(74) *Attorney, Agent, or Firm* — Adam R. Stephenson, Ltd.

(57) ABSTRACT

A golf club head cover. Implementations may include a body portion defining an internal cavity for receiving a golf club head, a first flap disposed on the body portion and including a first magnetic fastener, and a second flap disposed on the body portion and including a second magnetic fastener. The first magnetic fastener and second magnetic fastener may substantially align with each other and may be aligned substantially parallel with the internal cavity of the body portion. Particular implementations may include a notch adjacent to the internal cavity and/or reentrant openings on both a side of the first flap and on a side of the second flap.

8 Claims, 19 Drawing Sheets

(56) References Cited

U.S. PATENT DOCUMENTS

| | | | | |
|---|---|---|---|---|
| 5,195,568 | A * | 3/1993 | Cirone | A63B 60/62 150/160 |
| 5,284,194 | A | 2/1994 | Gaffney | |
| 5,738,157 | A | 4/1998 | Gaffney | |
| 5,941,293 | A | 8/1999 | Serpa | |
| 6,044,880 | A | 4/2000 | Maeng | |
| 6,095,214 | A | 8/2000 | Gaffney | |
| 6,116,307 | A * | 9/2000 | Mangigian | A63B 60/62 150/160 |
| 6,192,950 | B1 | 2/2001 | Maeng | |
| 6,202,723 | B1 | 3/2001 | Maeng | |
| 6,321,805 | B1 | 11/2001 | Suggs | |
| 6,652,387 | B2 * | 11/2003 | Liberatore | A63B 21/06 150/160 |
| 6,719,111 | B2 * | 4/2004 | Bengtsson, Sr. | F16D 23/06 192/53.32 |
| 6,739,989 | B2 * | 5/2004 | Liberatore | A63B 69/0002 150/163 |
| 6,772,811 | B1 | 8/2004 | Kim | |
| 6,793,072 | B2 | 9/2004 | Maeng | |
| 7,699,083 | B1 * | 4/2010 | Kim | A63B 60/62 150/160 |
| 2003/0075252 | A1 | 4/2003 | Noyes | |
| 2003/0136485 | A1 | 7/2003 | Bradshaw | |
| 2004/0206433 | A1 | 10/2004 | Kim | |
| 2005/0016648 | A1 | 1/2005 | Vakharia et al. | |
| 2006/0201596 | A1 * | 9/2006 | Hwang | A63B 60/62 150/160 |
| 2007/0023116 | A1 | 2/2007 | Chen | |
| 2007/0068611 | A1 * | 3/2007 | Hwang | A63B 60/62 150/160 |
| 2007/0137959 | A1 | 6/2007 | Zauderer | |
| 2007/0261772 | A1 | 11/2007 | Chow | |
| 2007/0277353 | A1 | 12/2007 | Kondo et al. | |
| 2009/0205760 | A1 | 8/2009 | Bettinardi | |

FOREIGN PATENT DOCUMENTS

| | | |
|---|---|---|
| JP | 2003-225335 | 12/2003 |
| JP | 3126555 U | 11/2006 |
| KR | 10-2005-0088054 | 9/2005 |
| KR | 20-0399240 | 10/2005 |
| WO | WO2006132482 | 12/2006 |

* cited by examiner

GOLF CLUB HEAD COVER

CROSS REFERENCE TO RELATED APPLICATIONS

This application is a continuation of the earlier U.S. Utility patent application to John Travis Gaffney entitled "Golf Club Head Cover," application Ser. No. 12/359,011, filed Jan. 23, 2009, now pending, which was a continuation-in-part of the earlier U.S. Utility patent application to John Travis Gaffney entitled "Golf Club Head Cover With Snap Closure," application Ser. No. 12/079,839, filed Mar. 28, 2008, which issued on Oct. 2, 2012 as U.S. Pat. No. 8,276,627.

BACKGROUND

1. Technical Field

Implementations disclosed in this document relate to sporting equipment, particularly golf clubs.

2. Background Art

Golf head covers are conventionally used while the various clubs required to play are carried in a bag or cart. Conventional golf head covers include "sock" types of golf club covers often used for protecting the woods. A wide variety of other cover shapes and types have been developed to cover the heads of the irons and putters. Each design attempts to balance many factors, which include ease of use, durability, degree of protection of the head, and cost.

SUMMARY

First implementations of a golf club head cover may include a body portion defining an internal cavity for receiving a golf club head, a first flap disposed on the body portion and including a first magnetic fastener, and a second flap disposed on the body portion and including a second magnetic fastener. The first magnetic fastener and second magnetic fastener may substantially align with each other and may be aligned substantially parallel with the internal cavity of the body portion.

First implementations of a golf club head cover may include one, all, or any of the following:

The body portion may further include a notch adjacent to the internal cavity.

The first flap and the second flap may each include a reentrant opening on a side of the first flap and on a side of the second flap.

Both the first magnetic fastener and the second magnetic fastener may each include a body having one or more magnets therein.

The body of the first magnetic fastener may include two opposing beveled edges and the body of the second magnetic fastener may include two opposing beveled edges. When the first magnetic fastener and the second magnetic fastener are substantially aligned, the two opposing beveled edges of the first magnetic fastener and the two opposing beveled edges of the second magnetic fastener may form two Y-shaped openings.

The first magnetic fastener and the second magnetic fastener may be aligned in the direction of insertion of a golf club into the golf club head cover.

The first magnetic fastener may be included within the first flap and the second magnetic fastener may be included within the second flap.

The first flap may include a pocket and the first magnetic fastener may be included therein. The second flap may include a pocket and the second magnetic fastener may be included therein.

Second implementations of a golf club head cover may include a body portion defining an internal cavity for receiving golf club head, a first flap disposed on the body portion, and a second flap disposed on the body portion. The body portion may include a notch adjacent to the internal cavity and the first flap and the second flap may each include a reentrant opening on a side of the first flap and on the second flap.

First and second implementations of golf head covers may utilize a method of securing a golf club head cover over the head of a golf club. The method may include positioning the shaft of a golf club adjacent to a Y-shaped opening defined by a first magnetic fastener and a second magnetic fastener where the first magnetic fastener is included in a first flap coupled to a body portion of a golf club head cover and the second magnetic fastener is included in a second flap coupled to the body portion. The method may also include contacting the shaft of the golf club at only an edge of the first flap and at only an edge of the second flap located between a notch included in the body portion and a reentrant opening included in each of the first flap and in the second flap, respectively. The method may include pushing the shaft of the golf club past the first magnetic fastener and the second magnetic fastener as a head of the golf club passes into an internal cavity within the body portion, and securing the head cover over the golf club head using the first magnetic fastener and the second magnetic fastener.

Implementations of a method of securing a golf club head cover over the head of a golf club may include one, all, or any of the following:

Pushing the shaft of the golf club may further include spreading the first flap and the second flap apart at the edge of the first flap and at the edge of the second flap using the shaft of the golf club.

The method may further include removing the golf club head from the golf club head cover.

Other independent features and advantages of the golf club cover with a snap closure will become apparent from the following detailed description, taken in conjunction with the accompanying drawings which illustrate, by way of example, the principles disclosed herein.

DETAILED DESCRIPTION

The following detailed description is merely exemplary in nature and is not intended to limit the application and uses of the principles disclosed in this document. Furthermore, there is no intention to be bound by any theory presented in this document. Reference will now be made in detail to various implementations illustrating the principles disclosed in this document, examples of which are illustrated in the accompanying drawings. Wherever possible, the same reference numbers will be used throughout the drawings to refer to the same or like parts.

Figure 1:
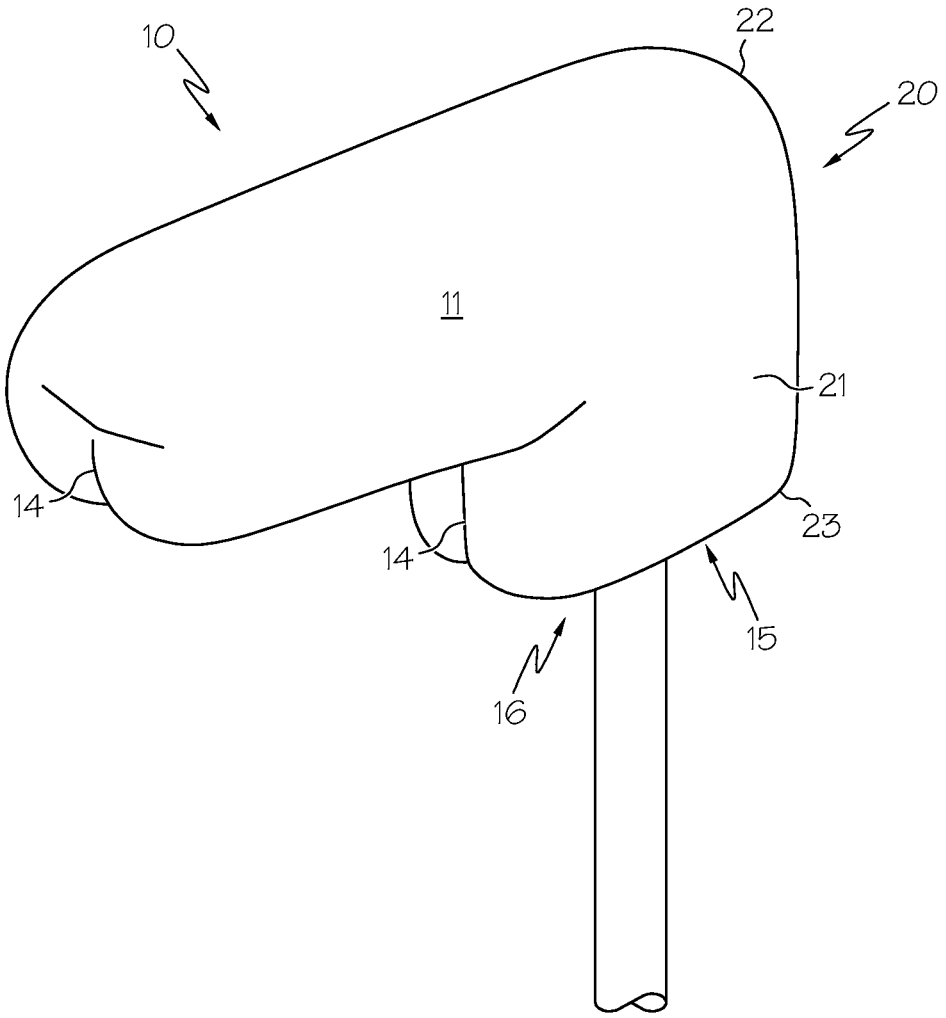
FIG. 1 is a perspective view of an implementation of a golf club cover and golf club head.
Figure 2:
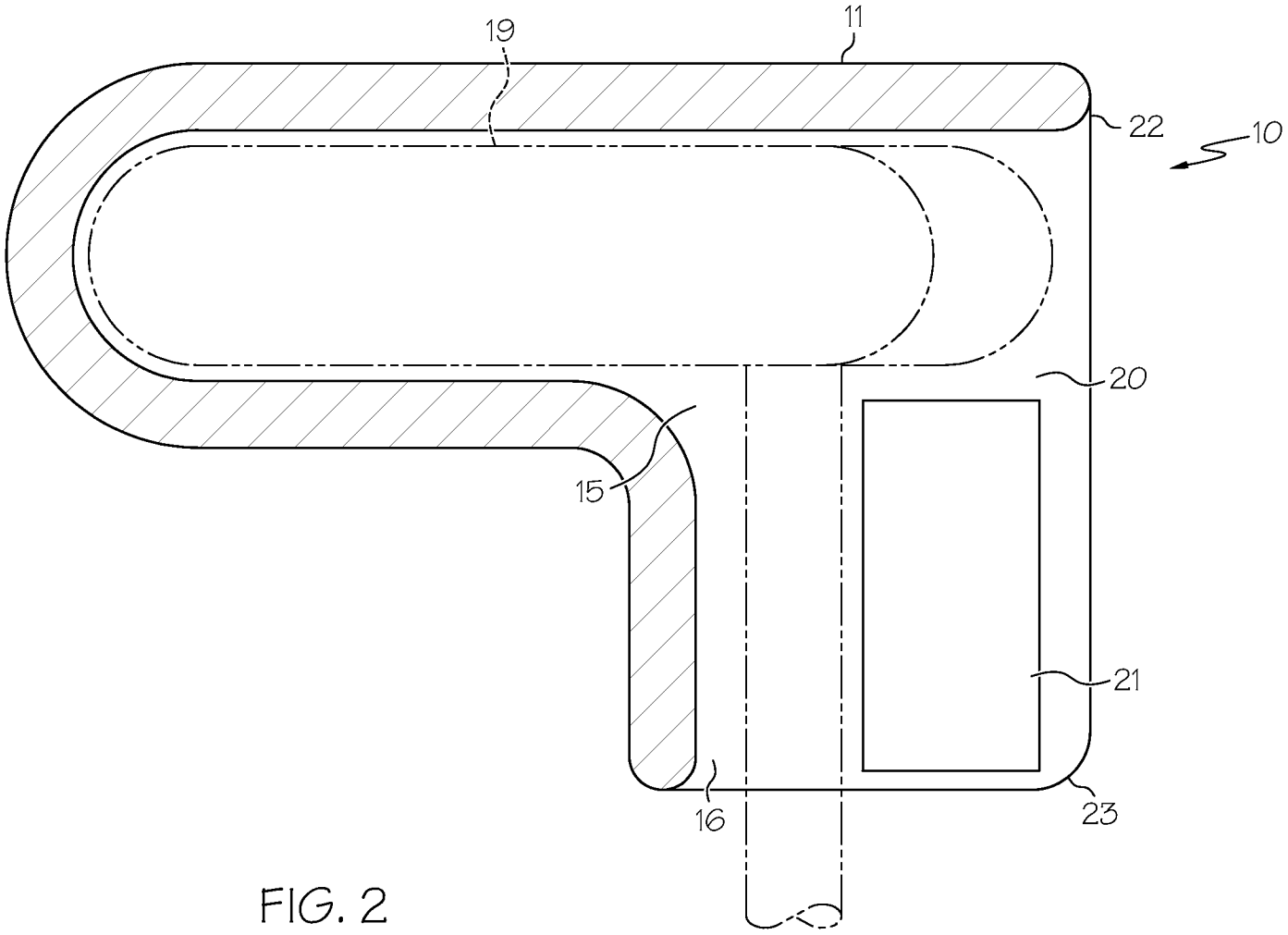
FIG. 2 is a further perspective view of an implementation of a golf club cover and golf club head.

Referring initially to FIGS. 1 and 2 there is shown a view of an exemplary golf club head cover 10. Cover 10 includes a main body portion 11 configured so as to define an internal cavity 15. Cavity 15 defines the space in which the head 19 of a golf club, such as a putter head 19, can be positioned. Body 11 of cover 10 can advantageously be formed of a single piece of material folded along one or more seams 14. Additionally, cover 10 may include multiple layers or laminates of materials. In a particular implementation, an outer layer of material provides a water proof or weather proof protection while an interior layer of a fleece-like or cushioned material provides a protective layer around cavity 15 for receiving head 19 of a golf club.

In various implementations, cover 10 includes opening 20. Opening 20 is defined by opposing flaps 21 which are wing-like structures of cover 10. While flaps 21 are just an extension of main body portion 11, flaps 21 are generally secured at an upper position proximate to top 22 of cover 10; and at the lower corner 23 are loose and unsecured. Thus, flaps 21 are generally free to open and close around opening 20 with more freedom of movement at corners 23 than at top 22. Cover 10 also preferably includes shaft opening 16, positioned generally toward the bottom or lower portion of cover 10, where the shaft of a golf club can be positioned when the cover is on the club.

Figure 3:
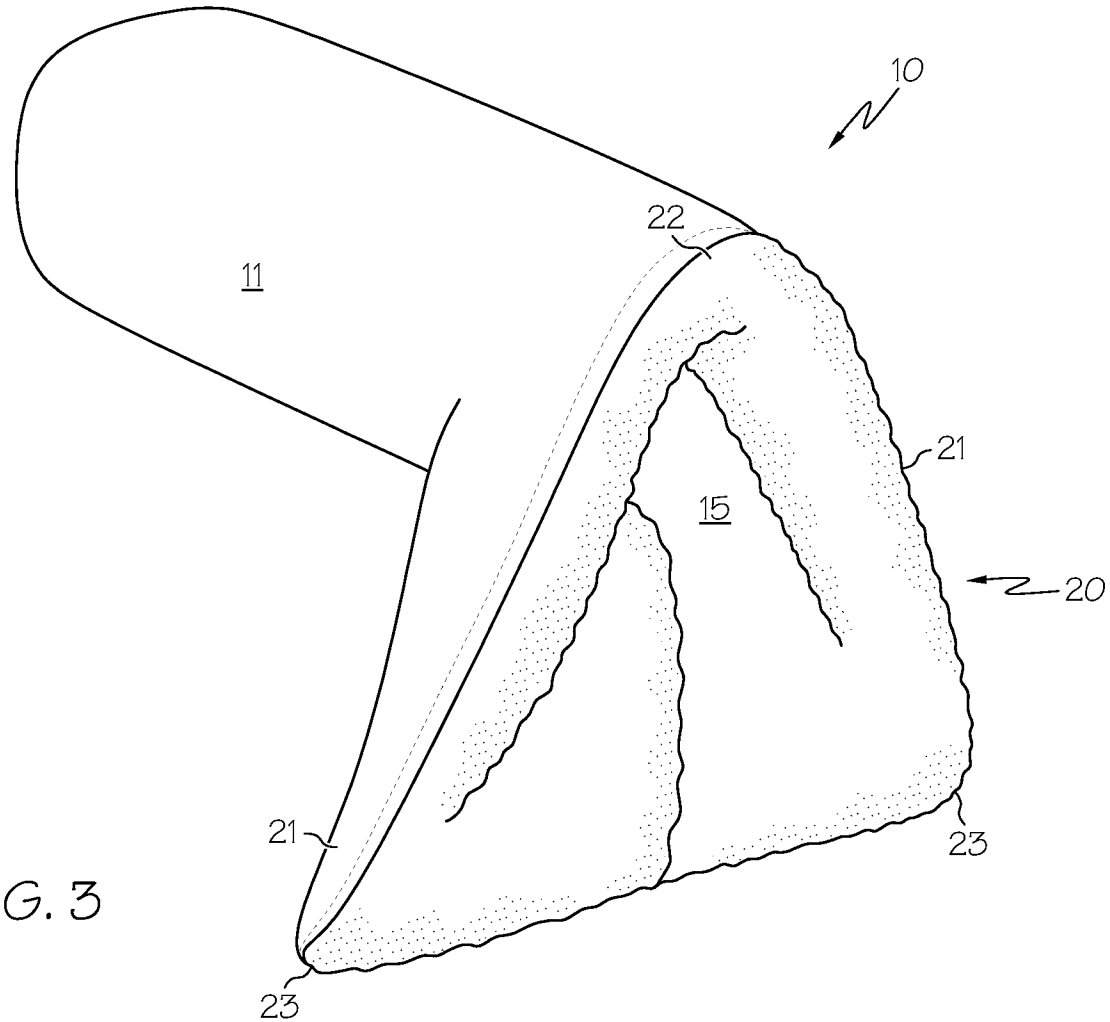
FIG. 3 is a further perspective view of an implementation of a golf club cover showing an opening.

FIG. 3 illustrates how, in particular implementations of golf head club covers, opening 20 provides a point of access through which a golf club can be inserted into and removed from internal cavity 15. U.S. Pat. No. 4,898,222 (the '222 patent) entitled "Golf Club Head Cover" to Gaffney, issued Feb. 6, 1990 (commonly assigned to the assignee of the present application, Arizona Manufacturing and Embroidery, LLC) and which is hereby incorporated entirely herein by reference discloses various implementations of golf club head covers. Like the implementations described in the '222 patent, in implementations of golf club head covers disclosed in this document, the head 19 of a putter can be inserted into and removed from a cavity 15 of cover 10.

Figure 4:
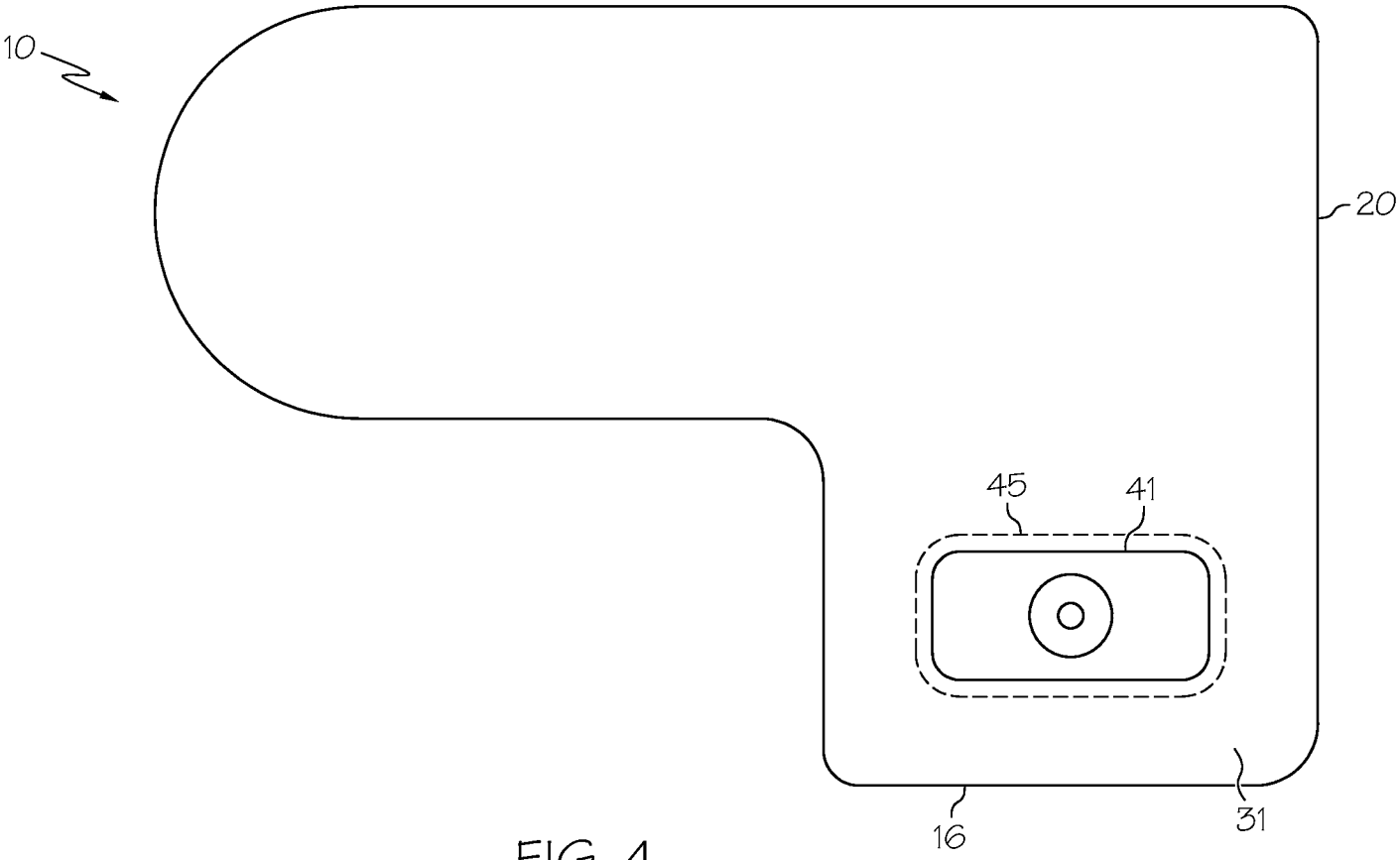
FIG. 4 is a perspective view of an implementation of a golf club cover having a pair of arm fasteners.
Figure 5:
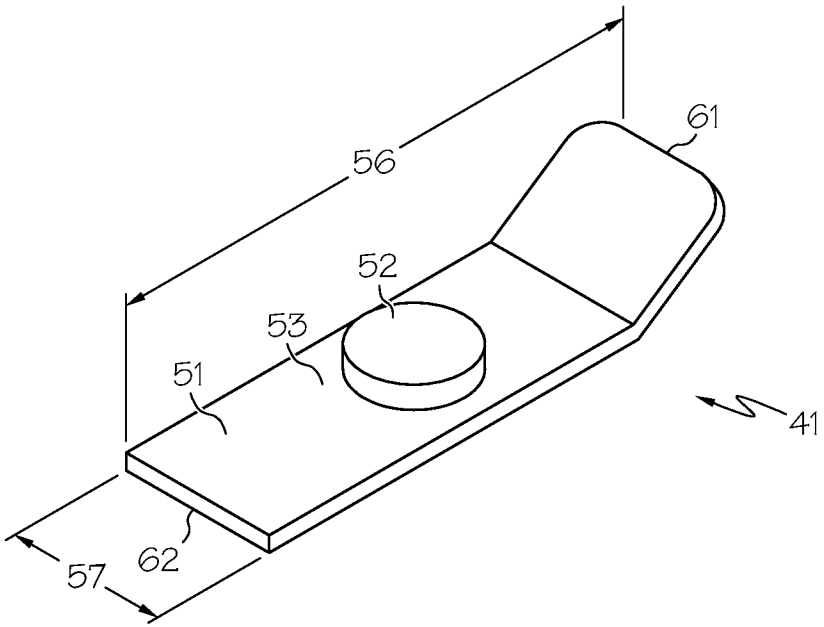
FIG. 5 is a perspective view of an implementation of an arm fastener.
Figure 6:
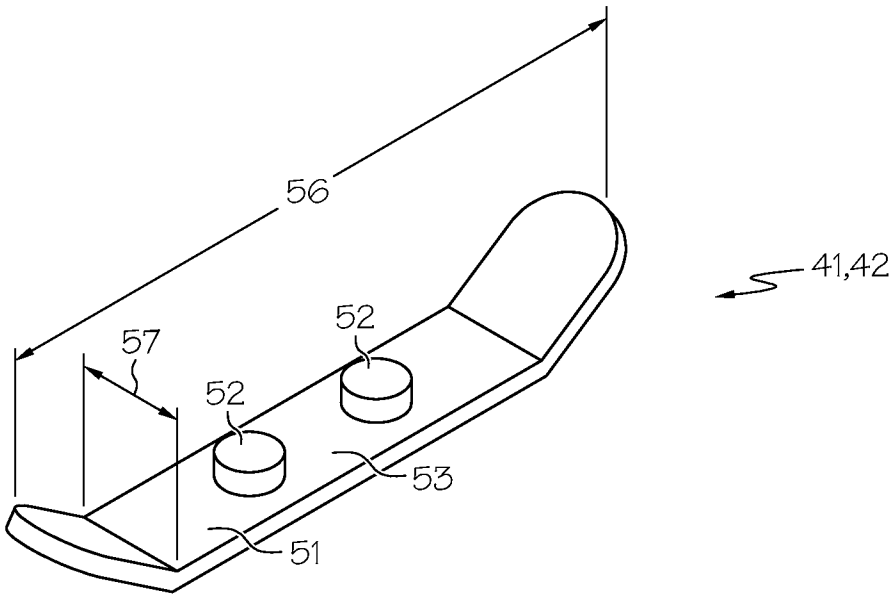
FIG. 6 is a perspective view of an implementation of a flange having a single curved edge.

Referring next to FIG. 4, an implementation of a golf head club cover 10 is illustrated having a pair of fasteners, magnetic fasteners, or arm fasteners 41, 42 positioned therein. Implementations of arm fasteners 41 are also illustrated in FIG. 5. In particular implementations, a first or left arm fastener 41 is positioned in a first or left flap 31, and a second or right fastener 42 is positioned in a second or right flap 32. Fasteners, 41, 42 are further illustrated in FIG. 5 which shows how implementations of each of fastener 41, 42 include a flange 51 and magnet 52. Flange 51 is preferably an elongate thin piece of metal. As shown in FIG. 5, flange 51 can have a curved end 61 and a straight end 62. However, as shown in FIG. 6, flange 51 may also include two curved edges. In implementations that include a curved end 61 and straight end 62, curved end 61 is preferably positioned toward the opening 20 of cover 10 so as to create a Y-shaped opening or Y-shaped area as further described herein. Also present in flanges 41 and 42 is a central or body portion 53. The central, body portion 53 of flanges 41 and 42 may define a generally flat or planar portion of the flange.

Figure 7:
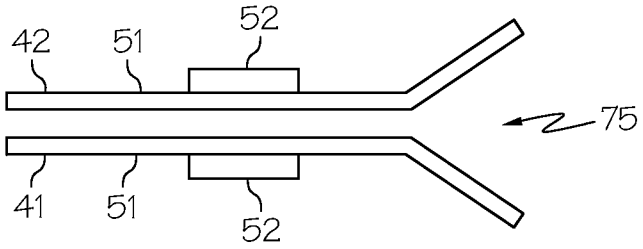
FIG. 7 is a perspective view of an implementation of a flange having double curved edges.

It may be further noted that as illustrated in FIG. 5, implementations of fasteners or flanges 41, 42 may have the curved end 61 of flanges 41 and 42 may set so that they curve or bend away from the plane established by the central or body portion 53 of flanges 41 and 42. Further, in particular implementations, each of flanges 41 and 42 may be positioned, one with respect to the other, such that curved ends 61 of each flange 41, 42 form a generally Y-shaped opening 75. FIG. 7 illustrates a paired set of flanges 41, and 42, viewed from above, with the material of cover 10 not shown. Thus, FIG. 7 shows a particular spatial arrangement of each of flanges 41 and 42 in which they define Y-shaped opening 75. As will be described with respect to the operation of various implementations of the invention, the configuration that creates the Y-shaped opening 75 may be useful in allowing a shaft of a golf club to be quickly placed within the Y-shaped opening 75 area, and then subsequently pushed past and through the Y-shaped opening 75 to secure the cover 10 over the golf club. Hence the general size of the area defined by flanges 41 and 42 together with Y-shaped opening 75 may be generally sufficient to receive a golf club shaft. Finally, it is noted that the offsetting angle (relative to central body portion 53) defined by curved end 61 may be a generally straight or a generally curved angle.

With respect to the overall shape and dimensions of flanges 51 and 52, it is noted that a wide variety of different configurations are possible. In particular implementations, flanges 51, 52 may be generally rectangular in overall shape such that the width dimension 56 is somewhat greater than the height dimension 57. It is noted that the width dimension 56 is measured from the flat end 62 to the farthest point of extension of a rounded end 61. Alternatively, when two rounded edges are present, it may be measured from a first rounded end point to the opposite rounded end point. While this rectangular shape may be used in particular implementations, and has been found functional for the intended purpose of securing covers over golf clubs, other configurations, such as square, round, or elliptical are possible. With respect to the thickness of flanges 51 and 52, a variety of thicknesses are possible so as to allow the snap closure to function for its intended purpose, yet without adding unnecessary weight or expense to the device. For example, implementations with a thickness of approximately under $\frac{1}{8}^{th}$ inch have been found to function successfully.

Flange 51 and 52 may comprise a metallic material. Further the metallic material that may be selected may be a material to which a magnetic would affix. However, non-magnetic metals may also be used. In particular implementations, it is also possible to compose flange 51 and 52 of a nonmetallic material such as a plastic.

Referring again to FIG. 5, implementations of a magnet 52 may be positioned so as to generally rest in the area defined by central body portion 53 of flange 51. Magnets 52 may take a variety of shapes; however, a generally circular shape has been found to function for the intended purpose. Further, while more than one magnet 52 may be used per flange 51, it has also been found that the pairing of a single magnet 52 with a single flange 51 may be sufficient for the intended purpose. The strength (magnetic force) of the magnet 52 is an important feature in selecting the size and dimensions of the magnet 52. As will be explained further herein, the force of magnetic attraction between opposing and paired sets of flange and magnet provides the force that allows the snap closure to function for its intended purpose. Thus, the desired force of the magnet 52 may generally be described as sufficiently strong so as to hold two paired arm fasteners 41 and 42 together, thereby holding left flap 31 and right flap 32 closed, and thereby holding the cover 10 on the golf club head during normal operation. However, the force of the magnet 52 should not be so strong so as to prevent a user (in normal usage) from being able to push the club through the snap closure when putting the cover on the golf club head, and conversely the force of the magnet 52 should not be so strong so as to prevent a user (in normal usage) from being able to pull the club through the snap closure when removing the cover from the golf club head. The magnets may or may not be permanently attached to their respective flanges. In particular implementations, a magnet may be glued to its respective flange.

Referring again to FIG. 4, implementations of fasteners 41 and 42 are illustrated positioned in cover 10. In one implementation, cover 10 is fashioned with pockets 45 and 46 in which fasteners 41 and 42 are positioned. It is noted that first pocket 45 is generally positioned in first flap 31, and second pocket 46 is generally positioned in second flap 32. In such an embodiment, each pocket 45 and 46 is shaped so that the gross external shape of pocket 45 and 46 can receive and hold fastener 41 and 42 in a generally desired position. Thus, pockets 45 and 46 are positioned with respect to cover 10 such that left fastener 41 will generally align with right fastener 42. Once a fastener 41 and 42 is placed in a pocket 45 and 46, the pocket 45 and 46 may be sealed shut such that the fastener 41 and 42 cannot escape from the pocket 45 and 46. While placing fasteners 41 and 42 in pockets 45 and 46 is the preferred method of securing fasteners 41 and 42 with respect to cover 10, other methods of securing may be used. For example, fasteners 41 and 42 may be glued to a fabric or substrate included within cover 10. Alternatively fastener 41 and 42 may be stitched to a portion of cover 10. Where, for example, flange 51 includes a flexible material, such as a plastic, the stitching method of attachment may be used. Other means of securing are also possible. However, regardless of the means used to secure fasteners 41 and 42 to cover 10, the fasteners 41 and 42 should be placed in a desired relationship configuration such that the fasteners 41 and 42 can mutually attract and attach to one another as further described herein.

Figure 8:
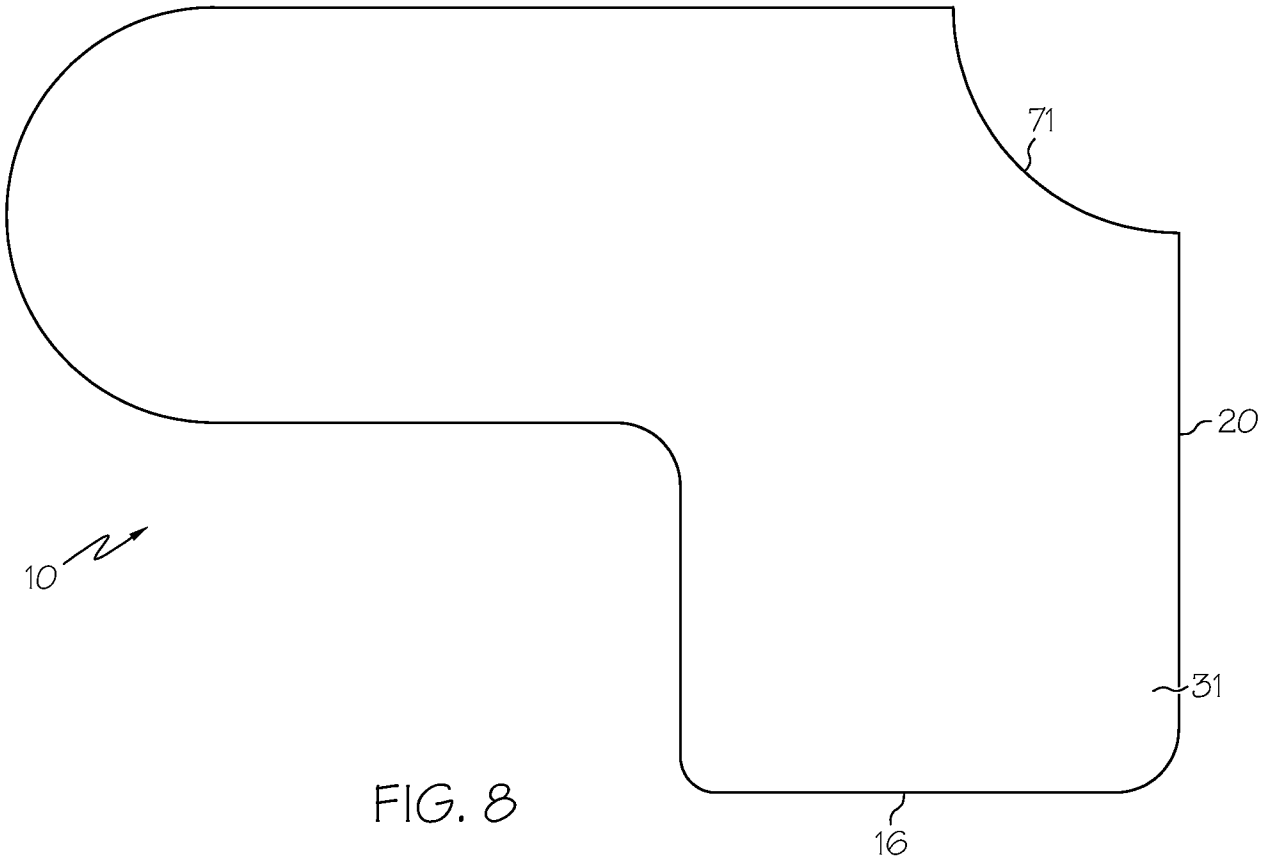
FIG. 8 is a perspective view of an implementation of a golf club head cover having a notch feature.

Referring to FIG. 8, an implementation of a cover 10 is illustrated that includes a notch 71. Notch 71 is a generally arcuate or cut away region in the upper corner of cover 10. Notch 71 is generally positioned in that area of cover 10 through which a putter head passes when the putter head is secured and removed from cover 10. Functionally, notch 71 serves to provide an increased area or roominess through which the putter head can pass. In cover 10 implementations that do not include a notch 71, the left flap 31 and right flap 32 generally come into proximity to each other. However, when a notch 71 is provided in the upper corner of cover 10, the act of removing material from each of left flap 31 and right flap 32, so as to create notch 71, relaxes somewhat the alignment of left flap 31 and right flap 32 in the corner area. Thus, in the area of notch 71, there may be an increased space. This increased space may be functional, particularly in the implementations with the snap fastener described herein, in that it allows the putter head to more quickly snap through the closure, without encountering significant resistance from the cover itself. Thus, the desired result, a smooth but effective snap through placement of the cover, on and off the golf club head, may be achieved.

Having described the golf club cover from a structural standpoint, an implementation of a method of using the golf club cover will now be described. In broad and general terms, the golf club cover with a snap closure (a golf club head cover that includes magnetic fasteners) provides a functional but convenient method for affixing and removing a cover from the head of a golf club. A golfer aligns the golf club, such as by pointing the tip of a putter head 19 toward the opening 20, and then pushes the head 19 through the opening 20 and into internal cavity 15. The shaft 18 of the golf club will cause the magnetic snap closure 41, 42 to briefly open so as to allow the shaft 18 to pass through the closure. Then, once the shaft 18 has passed the closure, meaning that the head 19 of the club has reached its resting place in the cover cavity 15, the snap closure then automatically (magnetically) closes so as to secure the golf club cover 10 around the club head 19.

Figure 9:
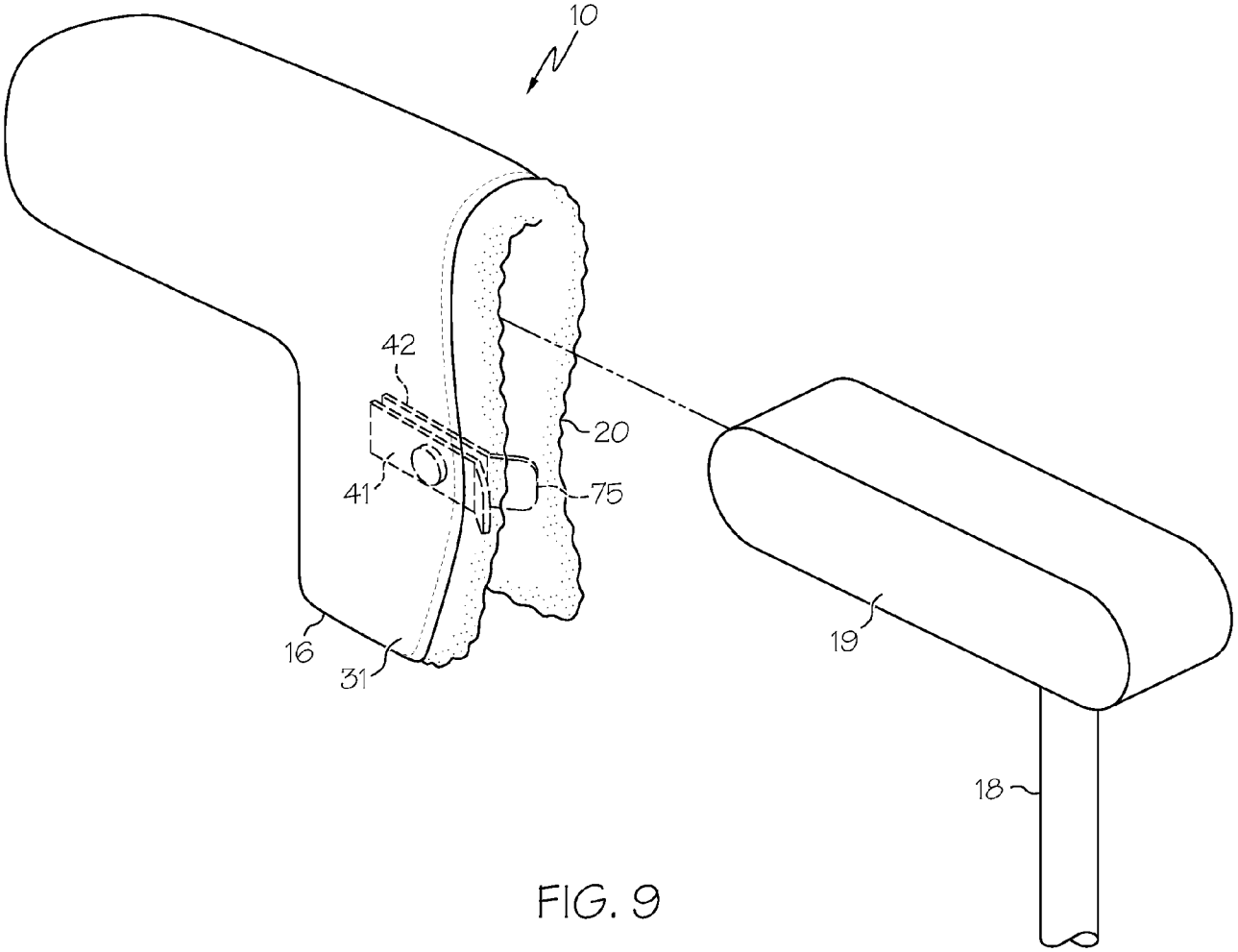
FIG. 9 is a perspective view of a golf club head cover with a golf club head in alignment therewith.

Referring first to FIG. 9, an implementation of a golf club head is shown in alignment with cover 10; in this position, the golf club head is ready to be pushed into the cover 10. It is noted that the snap closure is in the engaged or closed position; i.e., first arm fastener 41 is aligned with and magnetically connected to second arm fastener 42. The magnetic attraction between first arm fastener 41 and second arm fastener 42 is such that first flap 31 is held against second flap 32, thereby keeping opening 20 in a generally closed position. In the implementation illustrated in FIG. 9 the tip of the golf club head 19 is aligned with notch 71 of cover 10 so that the golf club head 19 can then be pushed through this area. It is also noted that the shaft 18 of the golf club is generally aligned with opening 20, so that shaft 18 can also be pushed through that area. Also, shaft 18 is generally positioned proximate Y-shaped opening 75. The general position shown in FIG. 9 is something of a preliminary or priming position. A human user can align the club as in this figure, and then, with a quick forward snap, engage cover 10 with the golf club head as further described herein.

Figure 10:
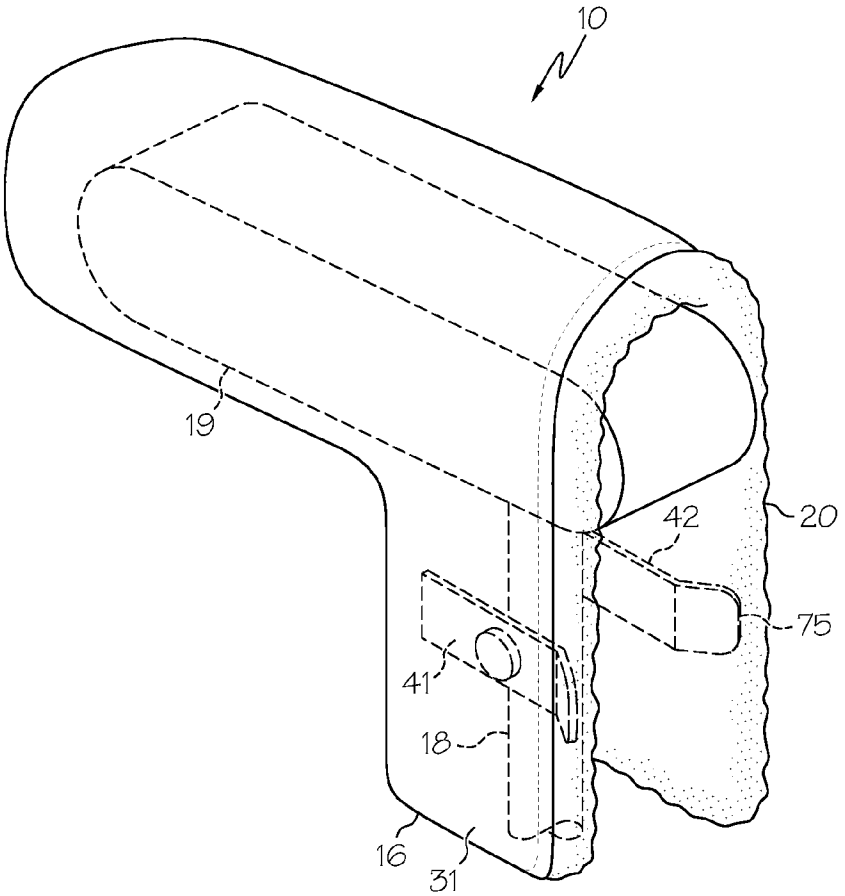
FIG. 10 is a perspective view of an implementation of a golf club head cover with a golf club shaft partially positioned therein so as to move the snap closure to an open or disengaged position.

Referring next to FIG. 10, we now see the implementation of a golf club head in a general midpoint of being joined with cover 10. Compared with FIG. 9, the shaft 18 has now been pushed through the Y-shaped opening 75. The force exerted by the shaft 18 in this movement has caused first arm fastener 41 to disengage with or open from second arm fastener 42. In other words, the force of the club shaft 18 has overcome the magnetic force that was holding the arm fasteners 41, 42 closed. However, as illustrated in FIG. 10, the club shaft 18 has not yet completely passed through the arm fasteners 41 and 42, rather the shaft 18 is at a midpoint of travel. It is also appreciated that the human movement that has put the shaft 18 in this position has also moved shaft 18 through the opening area 20 of cover. And likewise, the head of the golf club has partially passed through notch 71.

It is here noted that in particular implementations, material is positioned proximate opening 20 to allow for an easy passage of the golf club head 19 therebetween. A smooth and low friction material can advantageously be placed on slip pads 81, 82. The slip pads 81, 82 would preferably be positioned on left flap 31 and right flap 32 on their matching surfaces. Slip pads 81, 82 also generally conform to that surface area of cover 10 which golf club head 18 contacts as it passes through opening 20 and into cavity 15. Thus, by forming slip pads 81, 82 of a low friction material, slip pads 81, 82 allow the club head 19 to pass easily into cover 10.

Figure 11:
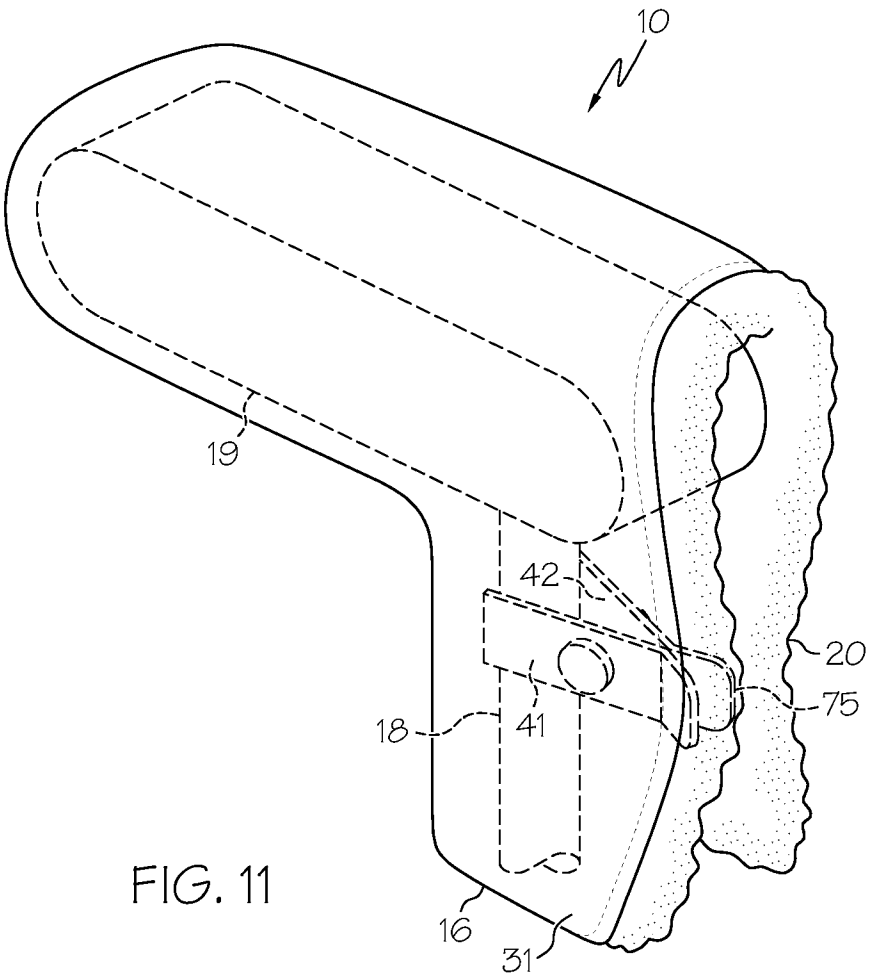
FIG. 11 is a further perspective view of an implementation of a golf club head cover now secured around a golf club head, thus showing the snap closure in the closed or engaged position.

Referring next to FIG. 11, an implementation of a golf club head cover 10 is shown fully secured on the head of the golf club. The positions of the club head 19 and cover 10 are just extensions of the movement that began in FIG. 9 and continued in FIG. 10. Now the shaft 18 has fully passed through the snap closure 41, 42. Both the shaft 18 and the golf club head 19 have come to rest in the desired locations when the cover 10 is positioned on the golf club head 19. For example the golf club head 19 rests in cavity 15. The shaft 18 extends downwardly and exits the cover 10 through shaft opening 16. As illustrated in FIG. 11, since there are no obstructions between the magnetic attraction of first arm fastener 41 and second arm fastener 42, these two have again joined in the engaged or closed position. In such a position left flap 31 is held close to right flap 32, which further act to securely hold the cover 10 on the golf club head 19.

Removal of the club from cover 10 is the reverse of the above steps. With a quick movement, the user pulls the golf club head 19 and shaft 18 past the closure 41, 42, momentarily opening the closure so as to allow the club to pass therethrough. The force of the club movement is sufficient to overcome the magnetic attraction which otherwise keeps the snap closure in the engaged/closed position. Once the club has exited the cover, the closure 41, 42 returns to the closed position.

Figure 12A:
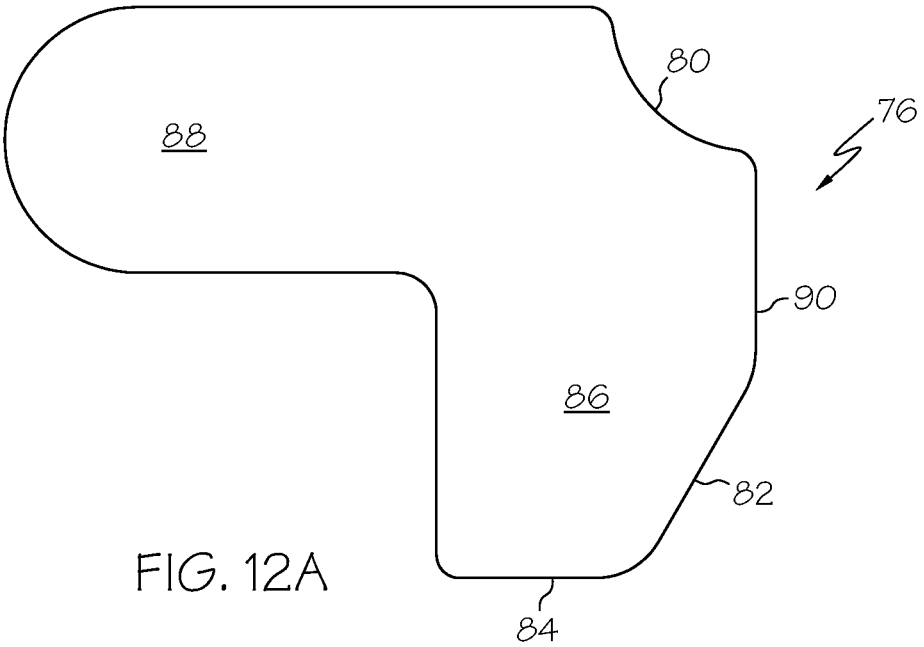
FIG. 12A is a side view of an implementation of a golf club head cover illustrating a notch in a body portion of the golf club head cover and a reentrant opening in a first flap and in a second flap coupled with the body portion.
Figure 12B:
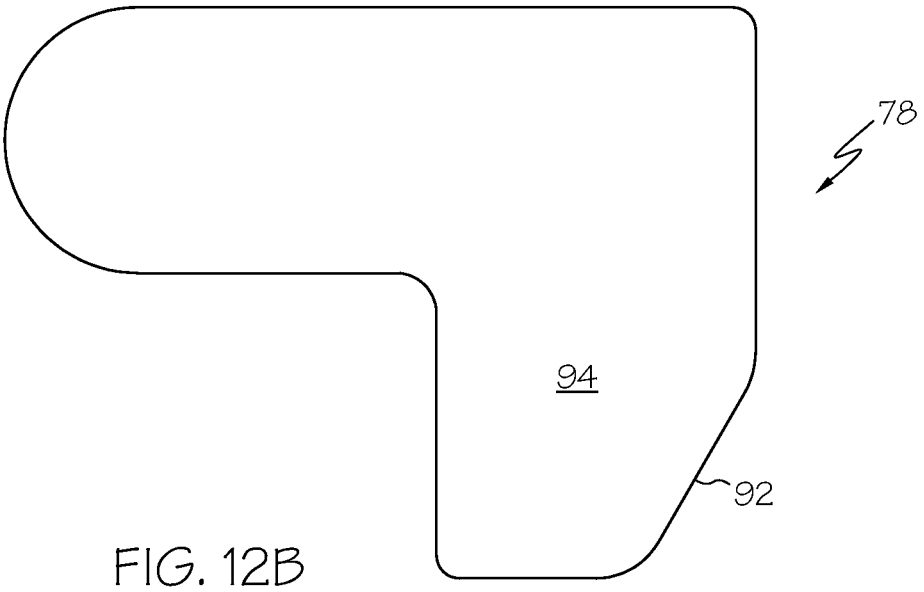
FIG. 12B is a side view of another implementation of a golf club head cover illustrating a reentrant opening in a first flap and in a second flap coupled with the body portion.

Referring to FIGS. 12A and 12B, two implementations of golf club head covers 76, 78 are illustrated. As illustrated, implementations of golf club head covers 76 like those illustrated in FIG. 12A may include a notch 80 and a reentrant opening 82 in an edge of each of the flaps 84. As used herein, the term "reentrant opening" includes all openings that extend inward from an edge or surface as well as openings created by removing a corner formed by the intersection of two edges. The flaps 84 may include a first flap and a second flap; in the views shown in FIGS. 12A and 12B only the first flap 86 is visible and the second flap is concealed. As illustrated, the notch 80 is adjacent to the internal cavity defined in the body portion 88. Also, the flaps 84 may include an edge 90 located between the notch 80 and the reentrant opening 82. The implementation of a golf club head cover 78 illustrated in FIG. 12B does not include a notch, but includes a reentrant opening 92 in flaps 94.

Figure 13A:
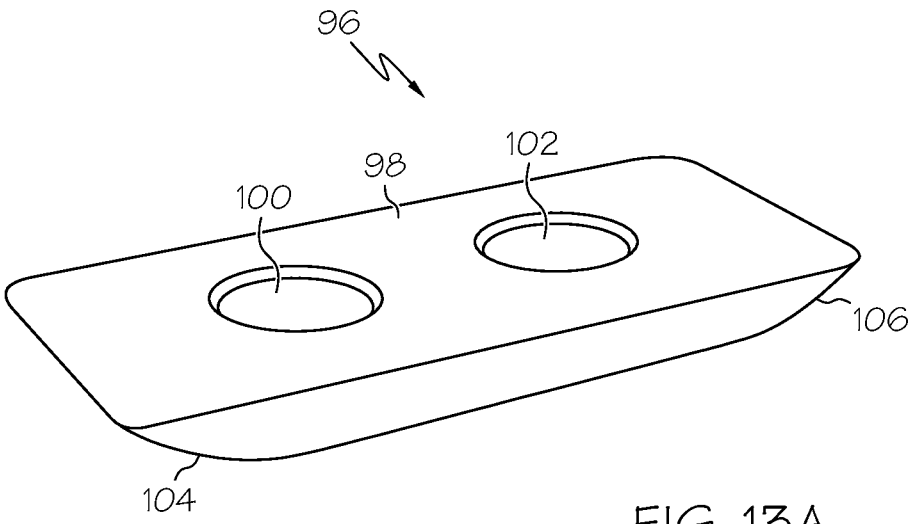
FIG. 13A is a perspective view of an implementation of a magnetic fastener.
Figure 13B:
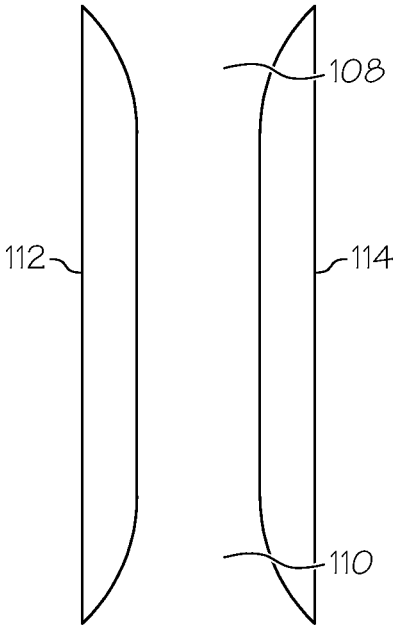
FIG. 13B is a side view of two implementations of magnetic fasteners aligned with each other, illustrating how the beveled edges of the magnetic fasteners create two Y-shaped openings.

Referring to FIG. 13A, an implementation of a fastener, arm fastener, or magnetic fastener 96 is illustrated. As illustrated, implementations of magnetic fasteners 96 may include a body 98 in which one or more magnets 100, 102 are included therein. In particular implementations, the magnets 100, 102 may be formed, inserted, or embedded in the body 98 through any of a wide variety of manufacturing processes, including, by non-limiting example, molding, fitting, extrusion, pultrusion, and any other forming process. In the particular implementation of a magnetic fastener 96 illustrated in FIG. 13A, the body 98 may be formed of a plastic material and the magnets 100, 102 may be formed of a metallic or semi-metallic material. The body 98 may include two beveled edges 104, 106 on opposing sides of the body 98. Referring to FIG. 13B, the two beveled edges 104, 106 may allow Y-shaped openings 108, 110 to be created when a first magnetic fastener 112 is substantially aligned with a second magnetic fastener 114. The arrangement of the first magnetic fastener 112 and second magnetic fastener 114 may function similarly to the other fastener implementations disclosed in this document.

Figure 14A:
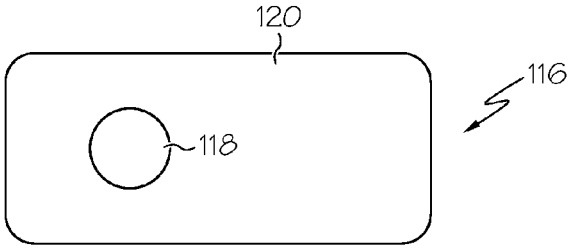
FIG. 14A is a top view of an implementation of a magnetic fastener with one magnet.
Figure 14B:
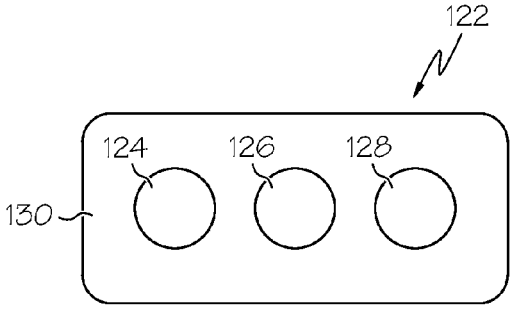
FIG. 14B is a top view of an implementation of a magnetic fastener with three magnets.
Figure 14C:
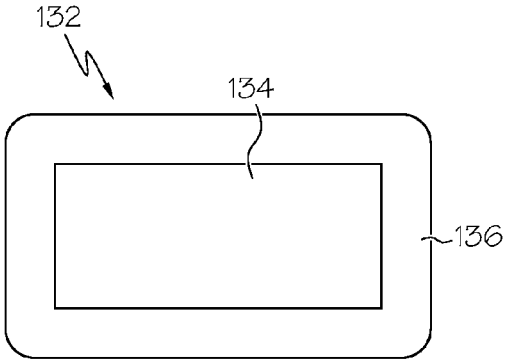
FIG. 14C is a top view of an implementation of a magnetic fastener with a block magnet.
Figure 14D:
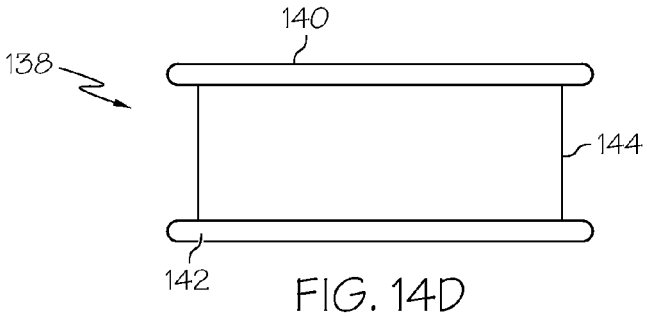
FIG. 14D is a top view of an implementation of a magnetic fastener with two magnets coupled at the sides of the magnetic fastener.

Any of a wide variety of magnetic fastener types may be implemented in particular implementations of golf club head covers disclosed in this document. Referring to FIG. 14A, an implementation of a magnetic fastener 116 that includes one magnet 118 offset relative to the center of the body 120 of the magnetic fastener 116 is illustrated. FIG. 14B illustrates an implementation of a magnetic fastener 122 that includes three magnets 124, 126, and 128 that are equally spaced along the body 130 of the magnetic fastener 122. FIG. 14C illustrates a magnetic fastener 132 that includes a single block magnet 134 in the body 136 of the fastener 132. FIG. 14D illustrates a magnetic fastener 138 that includes two magnetic strips 140, 142 disposed along two edges of the body 144. The magnetic strips may be similar to those used in various magnetic "zippers" or magnetic closures. In implementations of magnetic fasteners 138, the body 144 may be formed of a plastic material or of a flexible fabric webbing material that holds the two magnetic strips 140, 142 together. As FIGS. 14A-D illustrate, any of a wide variety of potential magnetic fastener implementations are possible.

Figure 15:
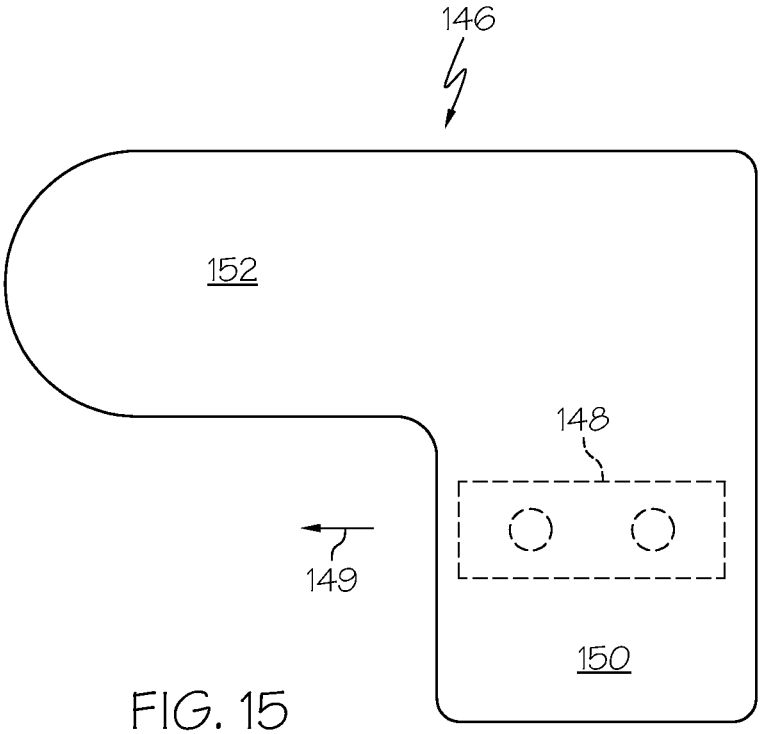
FIG. 15 is a side view of an implementation of a golf club head cover illustrating the orientation of the magnetic fastener relative to the body portion of the golf club head cover and relative to a direction of insertion of a golf club head into the golf club head cover.

Referring to FIG. 15, an implementation of a golf club head cover 146 is illustrated with the position of a magnetic fastener 148 indicated on a first flap 150. As illustrated, the magnetic fastener 148 is oriented in the direction of insertion of a golf club into the golf club head cover 146 (indicated by arrow 149); in other words, the longest or principal dimension of the magnetic fastener 148 is oriented in the direction a golf club shaft would pass as the golf club head is inserted into the body portion 152 of the golf club head cover 146. Experimentation has indicated that orienting the magnetic fastener 148 in this manner in particular implementations produces golf club head covers with desired ease of insertion and other use characteristics. While the magnetic fastener 148 is illustrated oriented substantially parallel (+/−10 degrees) to the internal cavity, in other implementations, the magnetic fastener 148 may be oriented at any angle up to perpendicularly relative to the internal cavity.

Figure 16A:
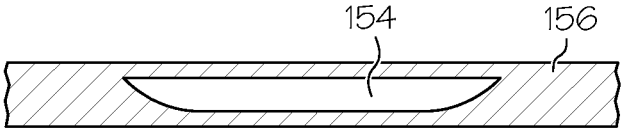
FIG. 16A is a cross sectional view of a flap of a golf club head cover illustrating a magnetic fastener included in the flap.
Figure 16B:
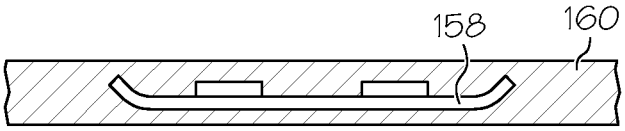
FIG. 16B is a cross sectional view of a flap of a golf club head cover illustrating a fastener, arm fastener, or magnetic fastener included in the flap.

Referring to FIG. 16A, an implementation of a magnetic fastener 154 is illustrated in a flap 156. As illustrated, the magnetic fastener 154 is disposed in the material included in the flap 156. Depending upon how the flap 156 is constructed, the magnetic fastener may be included between or as part of any one or more of many possible layers that could potentially be utilized to construct various flap implementations. FIG. 16B illustrates a fastener, arm fastener, or magnetic fastener 158 in flap 160 and that the fastener 158 may also be included between or as part of any one or more of the many possible layers used to construct the flap 160. Implementations of a magnetic fastener 154 and fastener 158 illustrated may be held in position within the flaps 156 and 160, respectively using any of a wide variety of techniques, including sewing, gluing, friction, hook and eye fasteners, or any other method of coupling a fastener to the material included in a flap. In particular implementations, a pocket may be included on both flaps; in other implementations, a pocket may be included on only one of the two flaps while the magnetic fastener is included in the other flap. A wide variety of potential arrangements are possible.

Figure 16C:
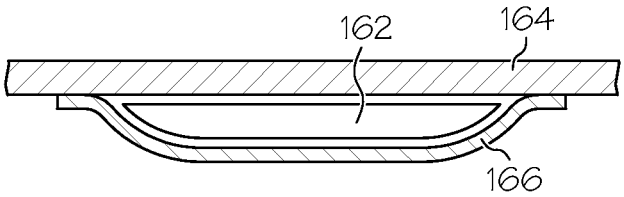
FIG. 16C is a cross sectional view of a flap of a golf club head cover illustrating a pocket on the flap including a magnetic fastener.
Figure 16D:
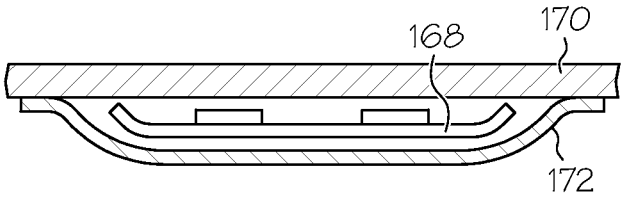
FIG. 16D is a cross sectional view of a flap of a golf club head cover illustrating a pocket on the flap including a fastener, arm fastener, or magnetic fastener.

FIG. 16C illustrates an implementation of a magnetic fastener 162 coupled with a flap 164 through a pocket 166. Pocket 166 may be coupled with flap 164 through any of a wide variety of methods, including, by non-limiting example, sewing, gluing, bonding, or any other method of coupling the particular materials that form the pocket 166 and the flap 164 together. FIG. 16D illustrates a fastener, arm fastener, or magnetic fastener 168 coupled with flap 170 through a pocket 172 coupled with the flap 170 through any of the methods disclosed in this document.

Figure 17:
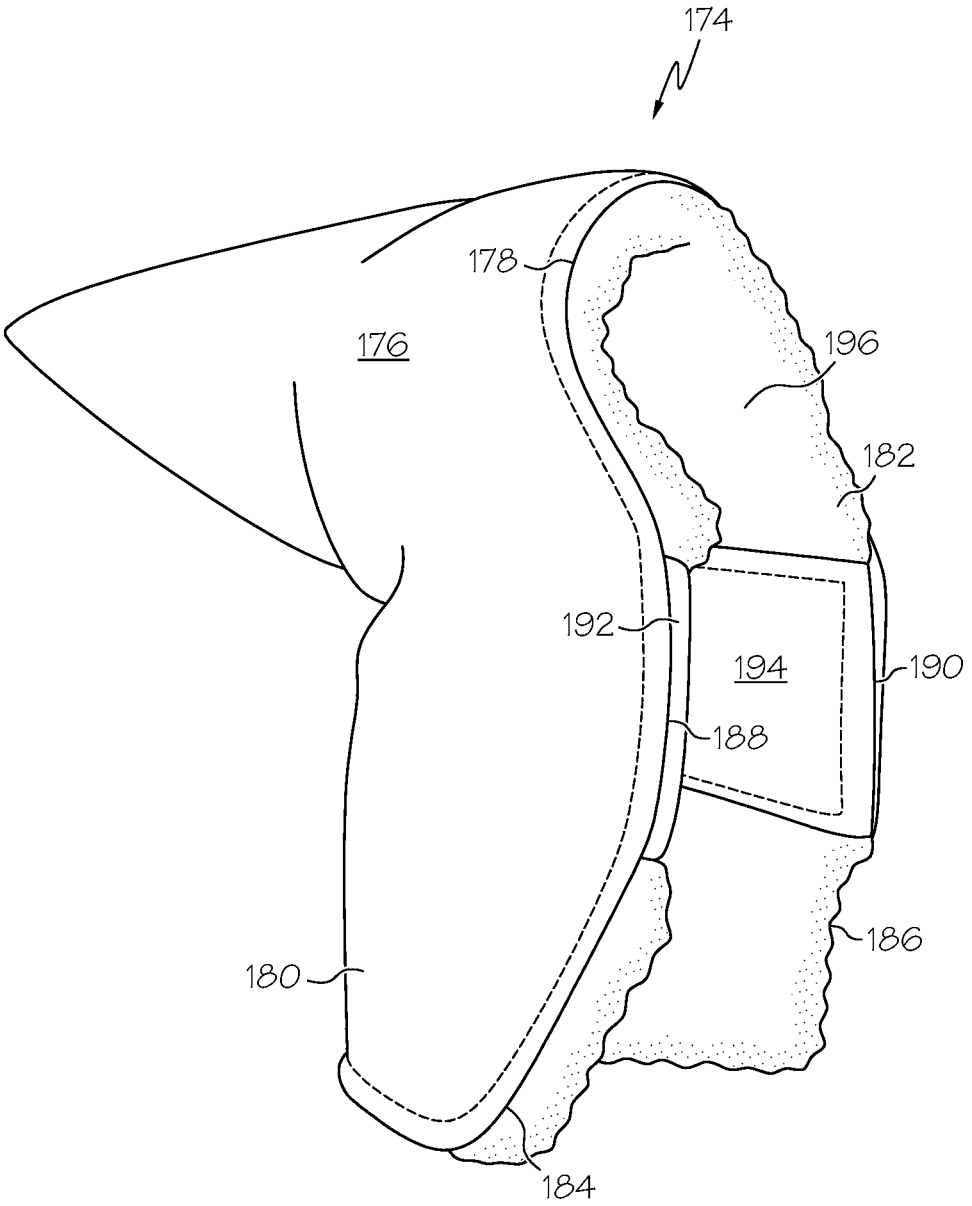
FIG. 17 is a rear perspective view of an implementation of a golf club head cover in an open position.
Figure 18:
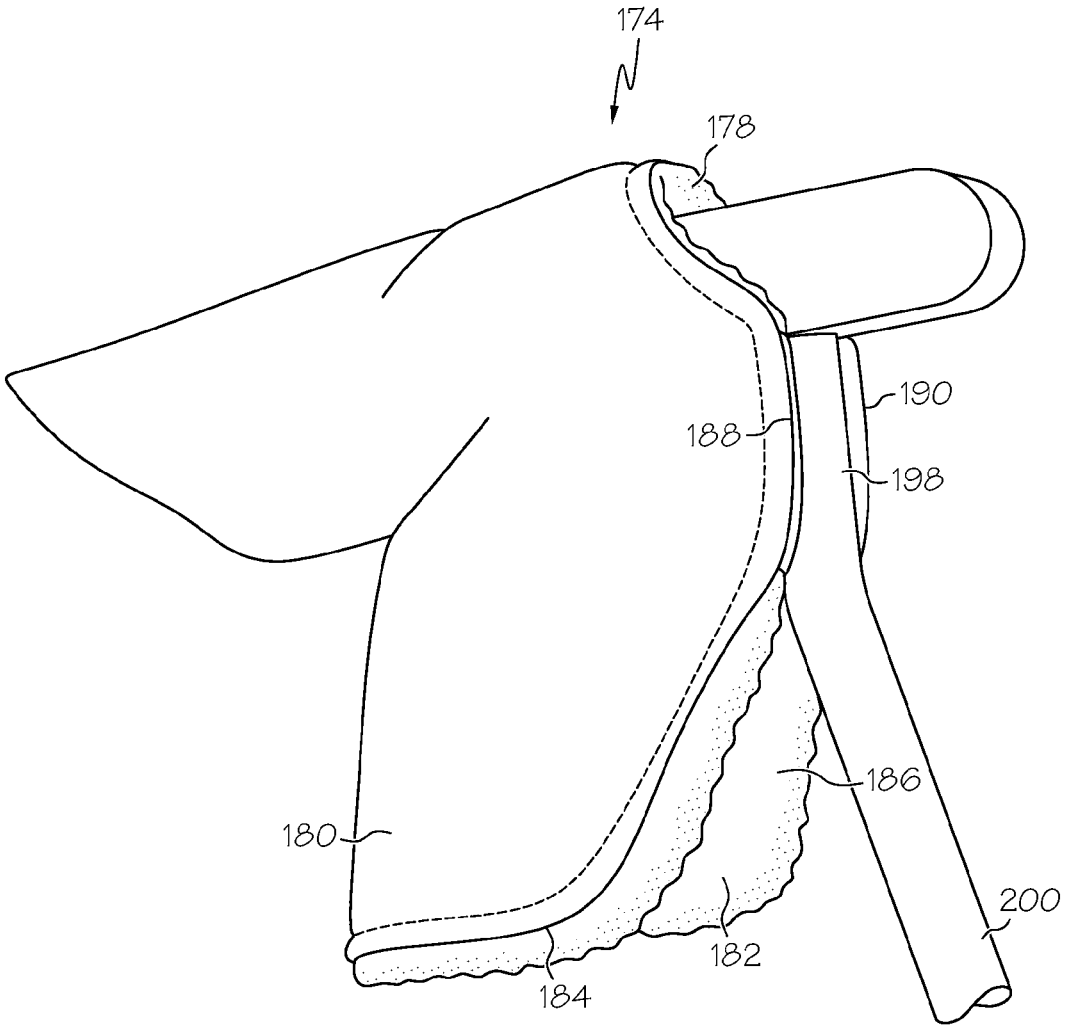
FIG. 18 is a rear perspective view of an implementation of a golf club head cover with a golf club partially inserted illustrating how the shaft of the golf club contacts only an edge of a first flap and a second flap of the golf club head cover located between a notch and a reentrant opening in both flaps as the golf club is inserted.

Referring to FIG. 17, an implementation of a golf club head cover 174 is illustrated. In the implementation of the cover 174 illustrated, the body portion 176 includes notch 178 and a first flap 180 and a second flap 182. The first flap 180 includes reentrant opening 184 and the second flap 182 includes reentrant opening 186, which serve to define edges 188 and 190 of the first flap 180 and second flap 182, respectively between the notch 178 and the reentrant openings 184, 186. The implementation illustrated in FIG. 17 is in the open position, where magnetic fasteners in pockets 192 and 194 are separated from each other. Because of the presence of the notch 178 and the reentrant openings 184, 186, the size of an opening 196 in the golf club head cover 174 is larger than in implementations of golf club head covers that do not include the notch and/or the reentrant openings. Because of this, the golf club head cover 174 may be able to more easily receive awkwardly sized and/or shaped golf club heads, such as offset putters, and allow them to slide naturally into the cover without binding or contacting the edges of the opening 196. FIG. 18 illustrates how, in the implementation of a golf club head cover 174 illustrated in FIG. 17, the edges 188, 190 of the first flap 180 and second flap 182, respectively, align with and will contact the shaft 198 of a golf club 200. As illustrated, the notch 178 and reentrant openings 184, 186 keep the other edges of the opening 196 from contacting the shaft 198. Because of this, the user of the golf club head cover 174 may be able to more easily move the cover 174 from the closed to the open position during insertion of the golf club 200 into the cover 174, particularly when an awkwardly shaped golf club, like an offset putter, is being used.

Figure 19:
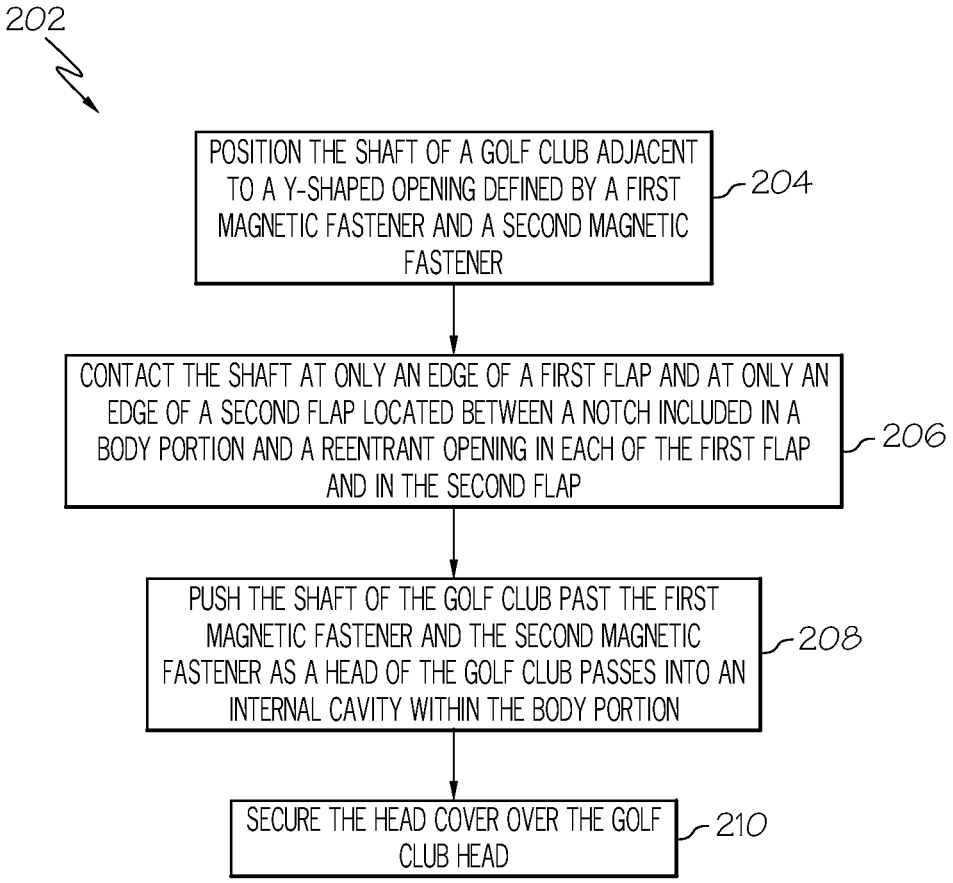
FIG. 19 is a flowchart of an implementation of a method of securing a golf club head cover over the head of a golf club.

Referring to FIG. 19, an implementation of a method of securing a golf club head cover over the head of a golf club 202 is illustrated. As illustrated, the method 202 includes the steps of positioning the shaft of a golf club adjacent to a Y-shaped opening defined by a first magnetic fastener and a second magnetic fastener (step 204), contacting the shaft at only an edge of a first flap and at only an edge of a second flap located between a notch included in a body portion of a golf club head cover and a reentrant opening in each of the first flap and in the second flap (step 206). As used herein, the shaft may also be another portion of various types of golf clubs such as a hosel or neck (in the case of certain types of offset putters). The method 202 may further include pushing the shaft of the golf club past the first magnetic fastener and the second magnetic fastener as a head of the golf club passes into an internal cavity within the body portion (step 208) and securing the head cover over the golf club head (step 210). As was previously discussed, because of the presence of the notch and of the reentrant openings, the shaft of a golf club being inserted into the golf club head cover will contact only the edges of the first flap and second flap between the notch and reentrant openings. This may aid the user in spreading apart the Y-shaped opening and the first magnetic fastener and second magnetic fastener to allow the cover to move to the open position.

While implementations have been described with reference to various examples, it will be understood by those skilled in the art that various changes may be made and equivalents may be substituted for elements thereof without departing from the principles disclosed in this document. In addition, many modifications may be made to adapt a particular situation or material to the teachings of the invention without departing from the principles disclosed herein.

What is claimed is:

1. A golf club head cover comprising:

a body portion defining an internal cavity for receiving a golf club head;

a first flap disposed on the body portion, the first flap comprising a first fastener enclosed in a first pocket, the first pocket coupled within material of the first flap; and a second flap disposed on the body portion, the second flap comprising a second fastener enclosed in a second pocket, the second pocket coupled within material of the second flap;

wherein the first fastener and the second fastener substantially align with each other when the first flap is held against the second flap through the first fastener and the second fastener.

2. The golf club head cover of claim 1 wherein the entire gross external shape of the first pocket and the entire gross external shape of the second pocket are coupled in the first flap and in the second flap, respectively.

3. The golf club head cover of claim 1 wherein a gross external shape of the first pocket and a gross external shape of the second pocket are configured to substantially overlap when the first flap is held against the second flap through the first fastener and the second fastener.

4. The golf club head cover of claim 1, wherein the first fastener and the second fastener each comprise a magnet.

5. The golf club head cover of claim 4, wherein the magnet of the first fastener is coupled to one of a flange and a body and the magnet of the second fastener is coupled to one of a flange and a body.

6. A golf club head cover comprising:

a body portion defining an internal cavity for receiving a golf club head;

a first flap disposed on the body portion, the first flap comprising a first magnetic fastener enclosed in a first pocket; and a second flap disposed on the body portion, the second flap comprising a second magnetic fastener enclosed in a second pocket;

wherein the first magnetic fastener and the second magnetic fastener substantially align with each other; and wherein the entire gross external shape of the first pocket and the entire gross external shape of the second pocket are coupled within material of the first flap and within material of the second flap, respectively.

7. The golf club head cover of claim 6, wherein the first magnetic fastener comprises one of a flange and a body and the second magnetic fastener comprises one of a flange and a body.

8. A method of securing a golf club head cover over the head of a golf club, the method comprising:

aligning a golf club with the golf club head cover by pointing a golf club head toward an opening in the golf club head cover;

pushing the golf club through the opening and into an internal cavity comprised in the golf club head cover;

opening a magnetic closure comprised in the golf club head cover through separating a first magnetic fastener coupled within material of a first flap comprised in the golf club head cover from a second magnetic fastener coupled within material of a second flap comprised in the golf club head cover using a shaft of the golf club, the first magnetic fastener and the second magnetic fastener comprised in the magnetic closure;

automatically and magnetically closing the magnetic closure after the golf club head has reached a resting position within the golf club head cover to secure the golf club head cover over the golf club.

* * * * *